US007420337B2

(12) United States Patent
Ren et al.

(10) Patent No.: US 7,420,337 B2
(45) Date of Patent: Sep. 2, 2008

(54) SYSTEM AND METHOD FOR OPEN LAMP PROTECTION

(75) Inventors: Yuancheng Ren, Hangzhou (CN); Peng Xu, San Jose, CA (US); Kaiwei Yao, Santa Clara, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 251 days.

(21) Appl. No.: 11/444,784

(22) Filed: May 31, 2006

(65) Prior Publication Data

US 2007/0278971 A1 Dec. 6, 2007

(51) Int. Cl.
*H05B 37/02* (2006.01)

(52) U.S. Cl. ..... 315/308; 315/362

(58) Field of Classification Search ..... 315/209 R, 315/224, 225, 226, 276, 291, 307, 308, 362; 361/18

See application file for complete search history.

(56) References Cited

U.S. PATENT DOCUMENTS 5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
5,930,126 A * 7/1999 Griffin et al. ..... 363/37
6,104,146 A 8/2000 Chou et al.
6,198,234 B1 3/2001 Henry
6,198,245 B1 3/2001 Du et al.
6,259,615 B1 7/2001 Lin
6,307,765 B1 10/2001 Choi
6,396,722 B2 * 5/2002 Lin ..... 363/98
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,654,268 B2 11/2003 Choi
6,657,274 B2 12/2003 Comeau et al.
6,756,769 B2 6/2004 Bucur et al.
6,781,325 B2 8/2004 Lee et al.
6,804,129 B2 * 10/2004 Lin ..... 363/98
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 3/2005 Choi
6,873,322 B2 3/2005 Hartular
6,876,157 B2 4/2005 Henry (Continued)

*Primary Examiner*—Thuy Vinh Tran
(74) *Attorney, Agent, or Firm*—Perkins Coie LLP; Zhou Lu

(57) ABSTRACT

A method for responding to an open lamp condition in a discharge lamp system is disclosed. The method monitors a current feedback signal flowing through a lamp and a voltage feedback signal indicative of a voltage across said lamp. A switch is used to switch between the current feedback signal to the voltage feedback signal upon detection of an open lamp condition.

8 Claims, 3 Drawing Sheets

U.S. PATENT DOCUMENTS 6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,057,611 B2 6/2006 Lin et al.
7,061,183 B1 6/2006 Ball
7,075,245 B2 7/2006 Liu
7,095,392 B2 8/2006 Lin
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
2002/0180380 A1 12/2002 Lin
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0158136 A1* 7/2006 Chen ..... 315/308
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.
2007/0103096 A1* 5/2007 Ren et al. ..... 315/312

* cited by examiner (a) (b)

SYSTEM AND METHOD FOR OPEN LAMP PROTECTION

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL).

BACKGROUND OF INVENTION

Fluorescent lamps are used in a wide variety of backlighting applications, such as for LCD displays, LCD televisions, and other types of consumer electronics. The fluorescent lamps are driven by an AC voltage. In mobile applications with typically only a DC power source, a DC/AC inverter is used to drive the fluorescent lamps. Even where AC power is available, a driver circuit is necessary to ensure that the appropriate AC driving waveform and voltage is applied to the lamps. The term controller encompasses both inverter and driver as used herein.

Typically, the backlight module includes more than one fluorescent lamp. When one or more of the fluorescent lamps fails, the failed fluorescent lamp presents an open circuit to the inverter or driver. This is referred to as an open lamp condition that causes the inverter to have an open lamp voltage.

Open lamp voltage handling and protection is often required in cold cathode fluorescent lamp (CCFL) inverter applications for safety and reliability reasons. In an open lamp condition, there might be a very large undesirable voltage occurring across outputs if protections are not in place. This undesirable voltage may be several times higher than a nominal output and could be harmful to circuit components. Thus, it is important for the inverter to safely and reliably operate under any anomalous conditions, such as an open lamp condition.

Under an open lamp condition, the lamp voltage will typically sweep up to 2~2.5 times normal operating voltage. The controller will then try to strike the lamp for 1~1.5 seconds. If the lamp does not turn on, the controller will shut down the system. Further, during the open lamp condition, the lamp voltage is much higher than the normal operating voltage. Therefore, the lamp voltage needs to be well controlled. If there are any instabilities in the system, the lamp and/or the controller can be easily damaged.

A prior art control scheme is shown in FIG. 1. The circuit includes a transformer with a primary side and a secondary side. The primary side is controlled by the (in this example) full bridge inverter. The full bridge inverter receives feedback from the secondary side of the transformer. Note that the lamp is connected to the secondary side of the transformer and sense nodes for current and voltage are used to feedback to the inverter.

Gvd is the transfer function from the duty cycle on the secondary winding to the output voltage. Gid is the transfer function from the duty cycle on the secondary winding to the lamp current. Cv represents the voltage sensing gain. Ri represents the lamp current sensing gain. Gm is the trans-conductance of the error amplifier. Gvt is the transfer function from the lamp voltage to time, during which the 140 uA current source discharges the compensation capacitor and lowers down the control voltage Vc. Fm represents the modulator gain.

Under normal operation, only the current loop operates. Under an open lamp condition, there are two cases. When all of the lamps are open, only the voltage loop works. When some lamps are open and some are still operating, both of the current loop and voltage loop work. Based on the system control chart in FIG. 1, the loop gain for both cases as shown in FIG. 2. FIG. 2(*a*) shows the loop gain under partial open lamp condition and FIG. 2(*b*) shows the loop gain under the complete open lamp condition.

The loop gain plots illustrate that the high Q of the resonant tank circuit of the inverter causes the system to be unstable because of little gain margin. It has also been found that a low frequency oscillation is observed. The frequency is determined by the difference between the resonant frequency and the switching frequency.

In order to achieve a stable system based on the prior art control method, either the loop gain must be lowered or the Q is dampened. If the gain is lowered, the lamp voltage regulation is lost. If the Q is dampened by inserting a resistor in the resonant tank, the system efficiency is adversely impacted.

BRIEF DESCRIPTION OF DRAWINGS

The following figures illustrate embodiments of the invention. These figures and embodiments provide examples of the invention and they are non-limiting and non-exhaustive.

DETAILED DESCRIPTION

Embodiments of a system and method that uses logic and discrete components to achieve open lamp voltage protection are described in detail herein. In the following description, some specific details, such as example circuits and example values for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with systems, circuits, and methods that are meant to be exemplary and illustrative. In various embodiments, the above problem has been reduced or eliminated, while other embodiments are directed to other improvements.

Figure 1:
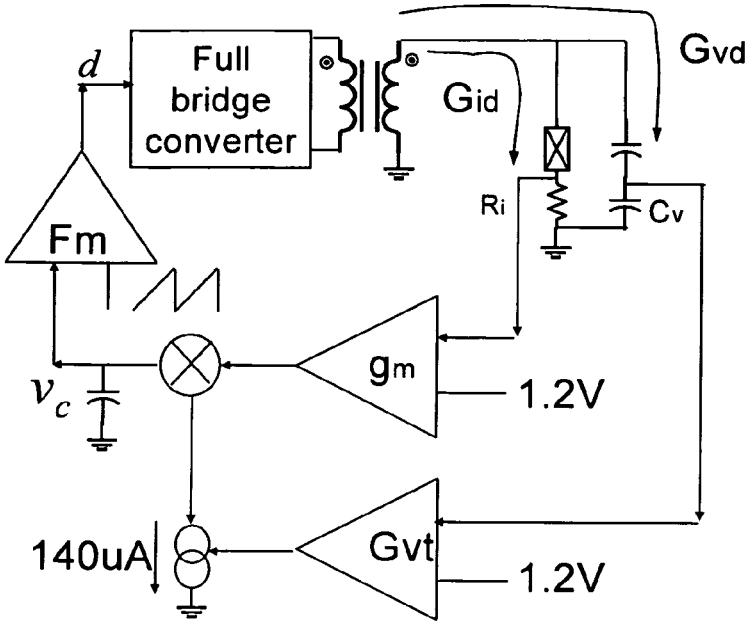
Figure 1 (Prior Art)
FIG. 1 shows a prior art open lamp protection circuit.
Figure 2:
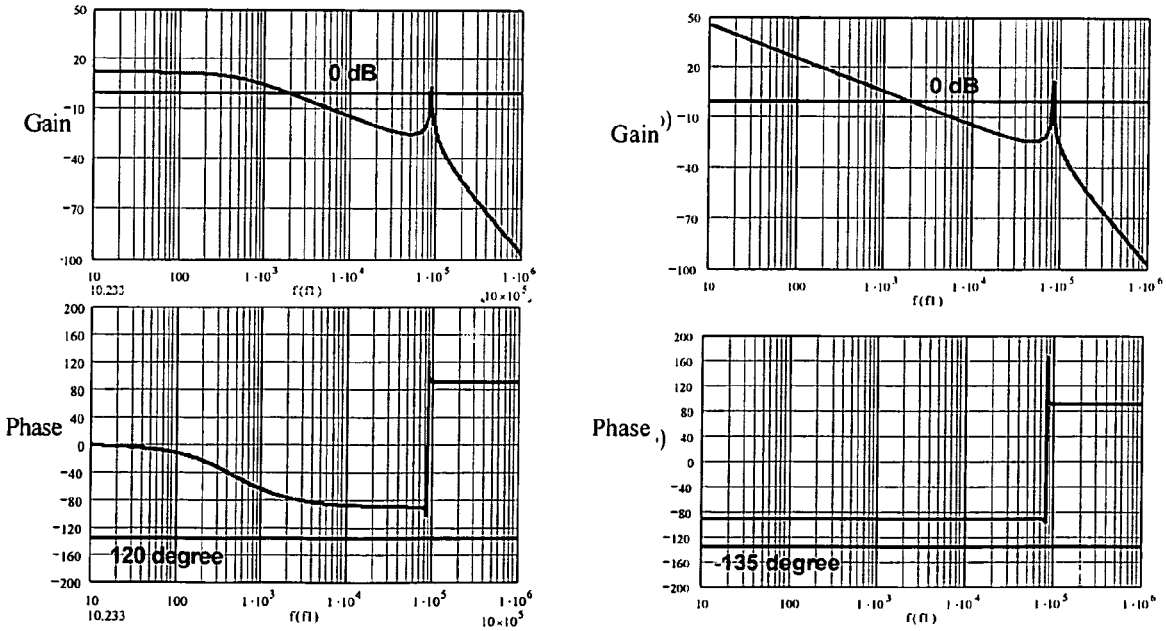
Figure 2 (Prior Art)
FIG. 2 shows the loop gain of the circuit of FIG. 1 when there is a partial open lamp condition (FIG. 2(*a*)) and when there is a complete open lamp condition (FIG. 2(*b*)).
Figure 3:
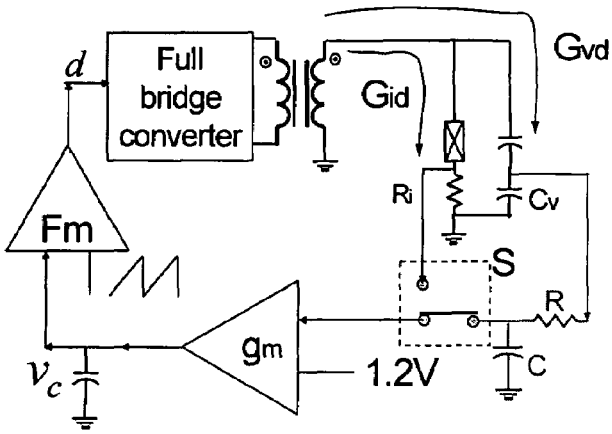
FIG. 3 is a schematic diagram of the circuit of the present invention.

The present invention relates to circuits and methods of open lamp voltage protection in discharge lamp applications. FIG. 3 shows a circuit formed in accordance with the present invention. It is similar to the prior art of FIG. 1, though there are still significant differences. First, there is a switch to either route the lamp current or the lamp voltage as the feedback parameter. During the normal operation, the current loop is used as the feedback. Thus, the circuit behaves like the prior art circuit of FIG. 1.

Figure 4:
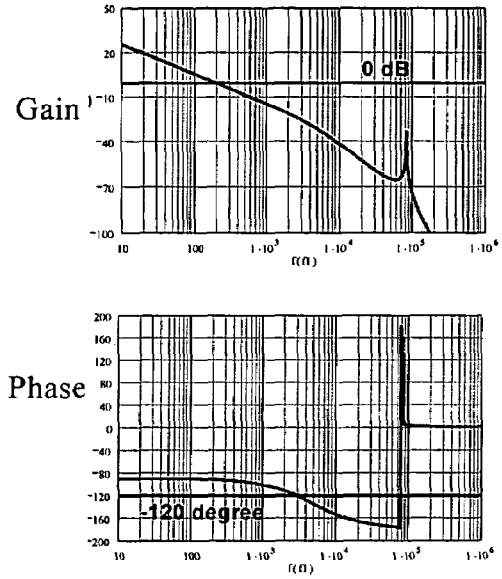
FIG. 4 shows the loop gain of the circuit of FIG. 3 when there is an open lamp condition.

Once the lamp is in an open lamp condition, the voltage loop kicks in and the current loop is disconnected. The switch thus moves to a position that allows the signal from the voltage loop to be fed back. Further, note that in the voltage loop, there is a low frequency filter (formed by R and C) to attenuate the high Q effect. The loop gain at open lamp condition is shown in FIG. 4. Another advantage of this control method is that only one error amplifier is needed.

Figure 5:
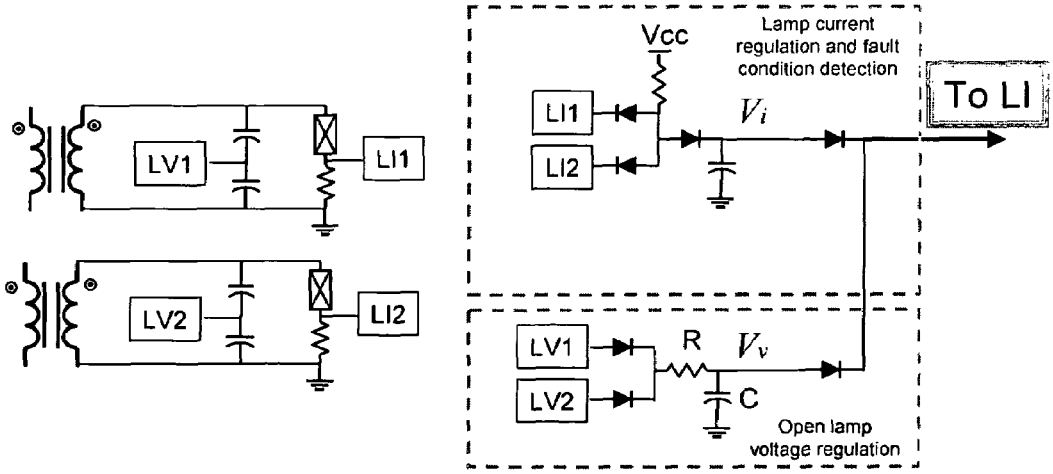
FIG. 5 shows one implementation of the circuit of FIG. 3 for an in-phase fluorescent lamp application.

Moreover, the present invention can be applied to in-phase and out-of-phase applications, respectively. FIG. 5 shows the implementation for an in-phase CCFL. During normal operation, $V_i$ is greater than $V_v$. Therefore, the lamp current is regulated. When the open lamp condition occurs, $V_i$ drops to zero. As a result, the lamp voltage, $V_v$ is regulated. It can be seen that the switch S is in this embodiment is comprised of two diodes. The low frequency filter is inserted into the voltage loop. Thus, the switch S can automatically detect an open lamp condition and switch in the voltage loop as the feedback.

Figure 6:
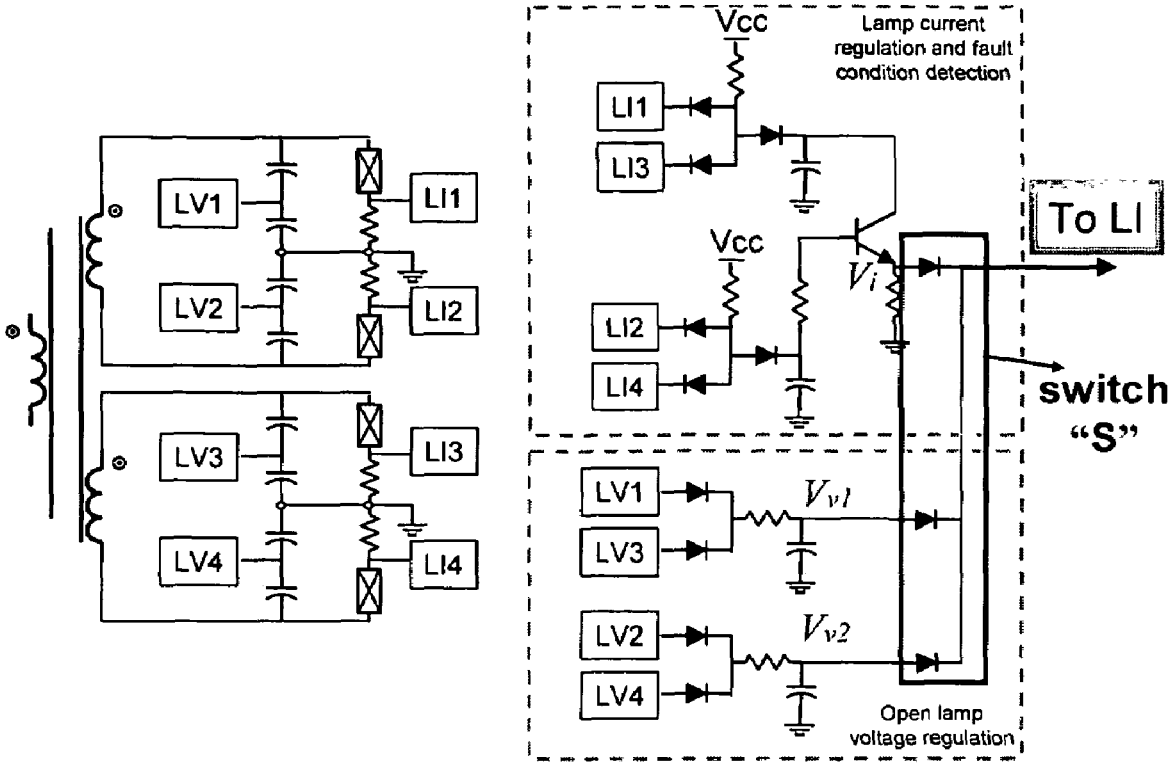
FIG. 6 shows one implementation of the circuit of FIG. 3 for an out-of-phase fluorescent lamp application.

FIG. 6 shows the implementation for an out-of-phase CCFL. During the normal operation, the lamp current is regulated. When the open lamp condition occurs, $V_i$ drops to zero. As a result, the lamp voltage, either $V_{v1}$ or $V_{v2}$ is regulated. The switch S is implemented in this embodiment by three diodes. The low frequency filter is inserted into the voltage loop to achieve a stable open lamp voltage.

The description of the invention and its applications as set forth herein is illustrative open lamp voltage protection and short circuit protection and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

We claim:

1. A method for responding to an open lamp condition in a discharge lamp system, comprising:

monitoring a current feedback signal flowing through a lamp;

monitoring a voltage feedback signal indicative of a voltage across said lamp;

switching from said current feedback signal to said voltage feedback signal upon detection of said open lamp condition.

2. The method in claim 1, further comprising:

low pass filtering said voltage feedback signal.

3. The method of claim 2 wherein said low pass filtering is performed with a RC filter.

4. The method in claim 1, wherein said voltage feedback signal and said current feedback signal are selectively switched to a single transconductance amplifier.

5. The method in claim 4, wherein said switch is formed from three diodes.

6. An apparatus for handling an open lamp condition in a discharge lamp system comprising:

a current sensing means for sensing a current feedback signal through said discharge lamp system;

a voltage sensing means for sensing a voltage feedback signal indicative of the voltage across said discharge lamp system;

a switch that will selectively route said current feedback signal during normal operation and said voltage feedback signal under an open lamp condition;

a transconductance amplifier for receiving either said voltage feedback signal or current feedback signal through said switch; and a feedback amplifier for receiving the output of said transconductance amplifier to control an inverter.

7. The apparatus of claim 6 wherein said switch is comprised of three diodes.

8. The apparatus of claim 6 furthering including a RC low pass filter for filtering said voltage feedback signal.

* * * * *